US010322905B2

(12) United States Patent
Helder

(10) Patent No.: US 10,322,905 B2
(45) Date of Patent: Jun. 18, 2019

(54) FOLDING METHOD AND FOLDING DEVICE AND DOCUMENT PROCESSING SYSTEM

(71) Applicant: Océ-Technologies B.V., Venlo (NL)

(72) Inventor: Matthieu W. J. Helder, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 475 days.

(21) Appl. No.: 14/870,413

(22) Filed: Sep. 30, 2015

(65) Prior Publication Data

US 2016/0096701 A1 Apr. 7, 2016

(30) Foreign Application Priority Data

Oct. 1, 2014 (EP) ..... 14187283

(51) Int. Cl.
*B65H 45/04* (2006.01)
*B42C 1/12* (2006.01)
(Continued)

(52) U.S. Cl.
CPC ..... *B65H 45/04* (2013.01); *B42C 1/12* (2013.01); *B65H 45/12* (2013.01);
(Continued)

(58) Field of Classification Search
CPC .... B65H 45/04; B65H 45/12; B65H 2301/45; B65H 2551/00; B65H 2557/60;
(Continued)

(56) References Cited

U.S. PATENT DOCUMENTS 5,045,039 A * 9/1991 Bay ..... B65H 15/00 493/1
8,982,410 B2 * 3/2015 Narita ..... H04N 1/00413 358/1.15

(Continued)

FOREIGN PATENT DOCUMENTS

EP 2 085 870 A2 8/2009
EP 2 306 299 A2 4/2011

OTHER PUBLICATIONS

Bastien "Pagination Catalog", XP-002736804, CIP4 organization, Version 1.3.4, Oct. 31, 2007, pp. 1-42.

*Primary Examiner* — Sameh Tawfik
(74) *Attorney, Agent, or Firm* — Birch, Stewart, Kolasch & Birch, LLP

(57) ABSTRACT

A method for generating a folding instruction for folding a stack of sheets into a document includes the steps of, for each sheet of the stack of sheets, receiving a folding action on the sheet defined by a fold type and an orientation relative to an observer, the fold type selected out of a mountain fold right, a mountain fold left, a mountain fold bottom, a mountain fold top, a valley fold right, a valley fold left, a valley fold bottom and a valley fold top; generating a function which has the folding action and the sheet as input and an ordered list of new sheets with an orientation relative to the observer of each new sheet of the list of new sheets as output; repeatedly applying the previous steps to each sheet of the at least one list of new sheets until the sheets in the last applied previous steps form the document; and generating a folding instruction including a concatenation of the at least one generated function on the stack of sheets, the folding instruction intended to be transmitted to a folding device for folding the stack of sheets into the document. A folding device and a document processing system for applying the method are also disclosed.

6 Claims, 19 Drawing Sheets

(51) Int. Cl.
*B65H 45/12* (2006.01)
*G03G 15/00* (2006.01)

(52) U.S. Cl.
CPC ..... *B65H 2301/45* (2013.01); *B65H 2551/00* (2013.01); *B65H 2557/60* (2013.01); *G03G 15/65* (2013.01); *G03G 15/6538* (2013.01); *G03G 2215/00877* (2013.01)

(58) Field of Classification Search
CPC ..... B42C 1/12; G03G 15/65; G03G 15/6538; G03G 2215/00877
USPC ..... 493/1, 39
See application file for complete search history.

(56) References Cited

U.S. PATENT DOCUMENTS

| | | | | |
|---|---|---|---|---|
| 9,335,956 | B2 * | 5/2016 | Hori | G03G 15/5095 |
| 9,387,701 | B2 * | 7/2016 | Klein Koerkamp | B41M 7/0081 |
| 9,430,721 | B2 * | 8/2016 | Dupre | G06K 15/005 |
| 9,875,070 | B2 * | 1/2018 | Nelson | G06F 3/1208 |
| 2005/0207812 | A1 * | 9/2005 | Miyazaki | B65H 45/12 399/407 |
| 2006/0136087 | A1 * | 6/2006 | Higashiura | H04N 1/00355 700/116 |
| 2009/0275456 | A1 * | 11/2009 | Neubauer | B42D 15/008 493/421 |
| 2010/0167891 | A1 * | 7/2010 | Sakata | B65H 45/142 493/25 |

* cited by examiner

| Fold type | Notation | Example |
|---|---|---|
| Mountain fold right | | |
| Mountain fold left | | |
| Mountain fold bottom | | |
| Mountain fold top | | |
| Valley fold right | | |
| Valley fold left | | |
| Valley fold bottom | | |
| Valley fold top | | |

Fig. 1

| Orientation | Example |
| --- | --- |
| (+x, +y, +z) |  |
| (+y, -x, +z) | |
| (-x, -y, +z) | |
| (-y, +x, +z) | |
| (-x, +y, -z) | |
| (+y, +x, -z) | |
| (+x, -y, -z) | |
| (-y, -x, -z) | |

$$\mathrm{f} \cdot \smile \cdot s = [s^l, \mathrm{flipy} \cdot s^r]$$

$$\mathrm{f} \cdot \smile \cdot s = [s^r, \mathrm{flipy} \cdot s^l]$$

$$\mathrm{f} \cdot \circlearrowright \cdot s = [s^l, \mathrm{flipx} \cdot s^r]$$

$$\mathrm{f} \cdot \circlearrowleft \cdot s = [s^r, \mathrm{flipx} \cdot s^l]$$

$$\mathrm{f} \cdot \frown \cdot s = [\mathrm{flipy} \cdot s^r, s^l]$$

$$\mathrm{f} \cdot \frown \cdot s = [\mathrm{flipy} \cdot s^l, s^r]$$

$$\mathrm{f} \cdot \supset \cdot s = [\mathrm{flipx} \cdot s^r, s^l]$$

$$\mathrm{f} \cdot \supset \cdot s = [\mathrm{flipx} \cdot s^l, s^r]$$

Fig. 5

$$\mathrm{F} \cdot \varphi . [\,] = [\,]$$

$$\mathrm{F} \cdot \smile \cdot [s] \oplus S = [s^r] \oplus \mathrm{F} \cdot S \cdot \smile \oplus [\mathrm{flipy} \cdot s^l]$$

$$\mathrm{F} \cdot \smile \cdot [s] \oplus S = [s^l] \oplus \mathrm{F} \cdot S \cdot \smile \oplus [\mathrm{flipy} \cdot s^r]$$

$$\mathrm{F} \cdot \frown \cdot [s] \oplus S = [s^l] \oplus \mathrm{F} \cdot S \cdot \frown \oplus [\mathrm{flipx} \cdot s^r]$$

$$\mathrm{F} \cdot \frown \cdot [s] \oplus S = [s^r] \oplus \mathrm{F} \cdot S \cdot \frown \oplus [\mathrm{flipx} \cdot s^l]$$

$$\mathrm{F} \cdot \frown \cdot [s] \oplus S = [\mathrm{flipy} \cdot s^l] \oplus \mathrm{F} \cdot S \cdot \smile \oplus [s^r]$$

$$\mathrm{F} \cdot \frown \cdot [s] \oplus S = [\mathrm{flipy} \cdot s^r] \oplus \mathrm{F} \cdot S \cdot \smile \oplus [s^l]$$

$$\mathrm{F} \cdot \smile \cdot [s] \oplus S = [\mathrm{flipx} \cdot s^r] \oplus \mathrm{F} \cdot S \cdot \smile \oplus [s^l]$$

$$\mathrm{F} \cdot \smile \cdot [s] \oplus S = [\mathrm{flipx} \cdot s^l] \oplus \mathrm{F} \cdot S \cdot \smile \oplus [s^r]$$

Fig. 6

FOLDING METHOD AND FOLDING DEVICE AND DOCUMENT PROCESSING SYSTEM

CROSS-REFERENCE TO RELATED APPLICATIONS

This application claims priority under 35 U.S.C. § 119(a) to application Ser. No. 14187283.8, filed in Europe on Oct. 1, 2014, the entire contents of which is hereby incorporated by reference into the present application.

BACKGROUND OF THE PRESENT INVENTION

1. Field of the Invention

The present invention relates to a method for generating a folding instruction for orthogonal folding of a stack of sheets into a document, the method comprising the step of, for each sheet of the stack of sheets, a) receiving an orthogonal folding action on the sheet defined by a fold type and an orientation relative to an observer, the fold type selected out of a mountain fold right, a mountain fold left, a mountain fold bottom, a mountain fold top, a valley fold right, a valley fold left, a valley fold bottom and a valley fold top.

The present invention further relates to a folding device for applying the method according to the present invention and a document processing system for applying the method according to the present invention.

2. Description of Background Art

Document processing systems and folding devices are known in which fold schemes can be applied according to a JDF specification of folding a single sheet. When folding a stack of sheets, a position and an orientation of a sheet in the folded stack of sheets is not stored and therefore becomes unknown.

It is an objective of the present invention to provide a method of orthogonal folding that is able to describe and compute arbitrary fold schemes on a stack of sheets.

SUMMARY OF THE INVENTION

According to the present invention, the objective is achieved by a method as described in the field of invention paragraph here-above, wherein the method comprises the steps of, for each sheet of the stack of sheets, b) generating a function which has the orthogonal folding action and the sheet as input and an ordered list of new sheets with an orientation relative to the observer of each new sheet of the ordered list of new sheets as output, the method comprising the steps of repeatedly applying steps a) and b) to each sheet of the at least one ordered list of new sheets until the sheets in the last applied steps a) and b) form the document, and generating a folding instruction comprising a concatenation of the at least one generated function on the stack of sheets, the folding instruction intended to be transmitted to a folding device for orthogonal folding of the stack of sheets into the document, wherein the orthogonal folding action on the sheet is also defined by a distance of an edge of the sheet to a fold line intended to be created by the orthogonal folding action and the sheets which form the document have at least two different sizes.

According to an embodiment of the present invention, the method further comprises the steps of transmitting the folding instruction to a folding device, receiving the folding instruction by the folding device, and folding the stack of sheets by the folding device into the document according to the folding instruction.

According to an embodiment of the present invention, the method further comprises the steps of generating a preview of the folded stack of sheets and displaying the generated preview. The preview may contain a reader spread of the folded—and cut or trimmed—stack of sheets.

According to an embodiment of the present invention, the step of generating the function comprises the step of generating as an output of the function a sheet join for a pair of sheets in the ordered list of new sheets, the pair of sheets being connected to each other by a fold line. This is advantageous, since this output of sheet joins makes it possible to generate an imposition for the original stack of sheets in order to create the folded stack of sheets. A preview of the imposition on the original stack of sheets may also be generated and displayed.

The present invention also relates to a folding device for folding a stack of sheets, the folding device comprising a receiver configured to receive a folding instruction generated by the method according to the present invention, wherein the folding device is configured to fold the stack of sheets into the document according to the folding instruction.

The present invention also relates to a document processing system comprising a sheet folding action receiver configured to receive a folding action on a sheet, a function generator configured to generate a function which has the folding action and the sheet as input and an ordered list of new sheets with an orientation relative to the observer of each new sheet of the ordered list of new sheets as output, a repeater configured for repeated use of the function generator for a stack of sheets, and a folding instruction generator configured to generate a folding instruction comprising a concatenation of the at least one generated function on the stack of sheets, the folding instruction intended to be transmitted to a folding device for folding the stack of sheets into the document, wherein the folding action on the sheet is also defined by a distance of an edge of the sheet to a fold line intended to be created by the orthogonal folding action and the sheets which form the document have at least two different sizes.

According to an embodiment of the document processing system according to the present invention, the function generated by the function generator has a sheet join as an output for a pair of sheets in the ordered list of new sheets, which pair of sheets is connected to each other by a fold line.

According to a further embodiment of the document processing system according to the present invention, the document processing system comprises a preview generator configured to preview an imposition for the original stack of sheets in order to create the folded stack of sheets.

According to an embodiment of the document processing system according to the present invention, the document processing system comprises a folding device according to the present invention.

The present invention also relates to a non-transitory computer readable medium comprising computer executable program code configured to instruct at least one computer to perform the method according to the present invention.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 shows primitive fold types according to an embodiment of a method of the present invention;

FIG. 5 shows a definition of a half fold function on a single sheet according to the embodiment of the method of the present invention;

FIG. 6 shows a definition of a half fold function on a stack of sheets according to the embodiment of the method of the present invention;

DETAILED DESCRIPTION OF THE PREFERRED EMBODIMENTS

Figure 2:
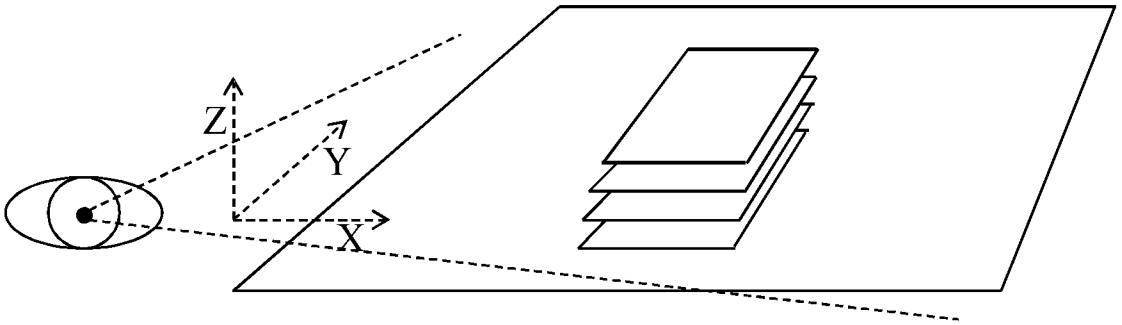
FIG. 2 shows an observer relative to the primitive fold types.

The present invention will now be described with reference to the accompanying drawings, wherein the same or similar elements are identified with the same reference numerals throughout the several views.

A function to describe folding has been developed by the inventor. With this function, the user is able to describe all folding schemes described in the JDF Fold Catalog. However, other folding schemes than described in the JDF Fold Catalog may be described with this function as well. The function can serve as a basis to describe the JDF folding schemes, i.e. the function describes folding of one or more sheets in an X and Y direction, also known as orthogonal folding. Given a list of sheets, the function produces an ordered list of sheets together with their respective orientations and positions in the folded stack.

FIG. 1 shows primitive fold types, which are candidates for implementation of such a function. The primitive fold types are known as: "Mountain fold right," "Mountain fold left," "Mountain fold bottom," "Mountain fold top," "Valley fold right," "Valley fold left," "Valley fold bottom," and "Valley fold top." These fold types are relative to some fixed point, which is called the observer.

FIG. 2 shows the observer as a fixed point. Every notion that is modeled has an orientation relative to the observer. It can be visualized as if the observer is looking at sheets lying on a desk as in FIG. 2. The sheets are chosen lying parallel to the X and Y axes.

Figure 3:
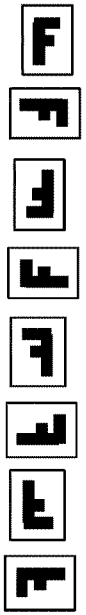
FIG. 3 shows orientations of a sheet for the observer in an XYZ plane according to the embodiment of the method of the present invention.

A sheet is determined to be a tuple consisting of its orientation in XYZ-space. FIG. 3 shows the three coordinate axes X, Y, Z of the sheet in terms of the coordinate system of the observer. Each orientation is accompanied with an example of the letter F on a sheet.

In the latter four orientations with −z, the sheet has been turned. It is noted that the +z and −z notation is actually not needed; each orientation can be expressed with x and y only. However, it is preferred to keep the z notation for clarity.

A first case is half folding at least one sheet. Half folding a single sheet as well as half folding a stack of sheets is covered by the first case.

Figure 4:
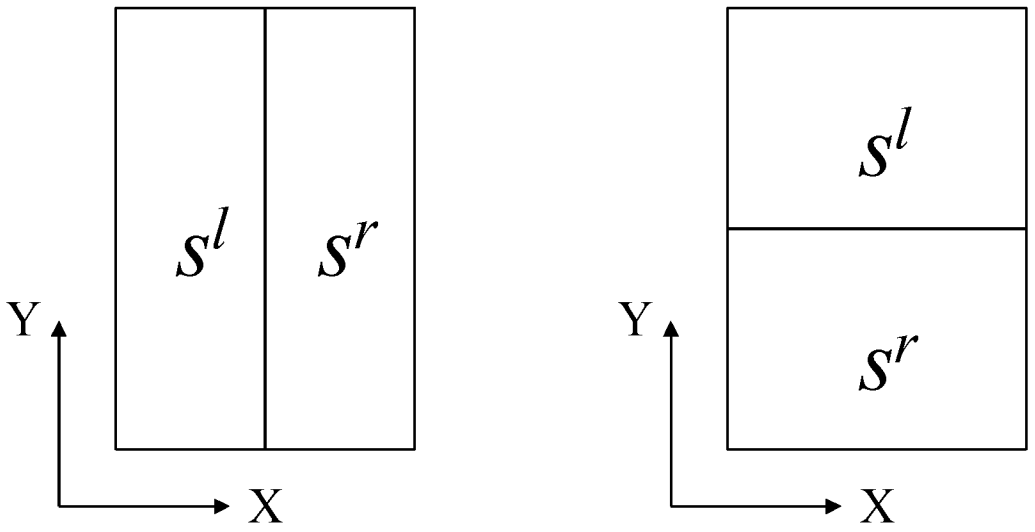
FIG. 4 shows new sheets due to a half fold of a sheet according to the embodiment of the method of the present invention.

A first half fold function f is defined that operates on a sheet and produces a list of sheets. The half fold function f further takes a fold type. A half fold always produces two new sheets, a sheet at the left of the fold and a sheet at the right of the fold as shown in FIG. 4(*a*). The two new sheets are denoted as $s^l$ and $s^r$ respectively. The two new sheets are joined together at a place of the fold. In case of a horizontal fold as shown in FIG. 4(*b*), the two new sheets may be called a sheet above the horizontal fold and a sheet below the horizontal fold. The two new sheets correspond to the original sheet before folding in the way as shown in FIGS. 4(*a*) and 4(*b*).

For example, the "Mountain fold left" on a sheet s may be denoted resulting in two sheets $s^l$ and $s^r$. Of the two sheets $s^l$ and $s^r$, $s^r$ is the sheet that lies on top after the fold.

In order to model the ordering "on top of" it is required that the list of sheets that the half fold function f produces is ordered. For example, for $s^l$ and $s^r$ holds that $s^r$ lies on top of $s^l$.

Apart from the order of the sheets, the half fold function f needs to express the orientation of the sheets. Two helper functions are introduced, i.e. flipx and flipy. The helper function flipx is the function "turn over the X-axis." The helper function flipy is the function "turn over the Y-axis."

The half fold function f is now completely defined per fold type by means of the two new sheets $s^l$ and $s^r$ and the two helper functions flipx and flipy as shown in FIG. 5.

By having completely defined a half fold function f on a single sheet s, a second half fold function F, being a recursive definition on the half fold function f, may be defined to express half folding of a stack of sheets S.

A stack of sheets can be represented as a list of sheets which is ordered by "on top of." The second half fold function F takes a fold type and an ordered list of sheets and produces an ordered list of sheets. The resulting order of the folded sheets may be derived for each fold type. If a stack of sheets is half folded, the sheets are folded around each other": the first and the last sheet are folded around the second and second to last sheet are folded around . . . etc.

The second half fold function F can be precisely defined by also taking into account the orientation of the folded sheets as shown in FIG. 6. An arbitrary fold type is denoted by the letter φ. It is noted that the second half fold function F expresses both a part-whole relation (by means of $s^l$ and $s^r$) and the on-top-of relation by means of the order on the lists.

The second half fold function F is used to express a single half fold function on the stack of sheets S. A series of half folds on an ordered list of sheets is then described by repeatedly applying the second half fold function F and by using an ordinary function composition on the second half fold function F.

It is concluded that the second half fold function F describes half folding a stack of sheets S. The second half fold function expresses both the orientation and the position of each sheet s in the stack of sheets S. A stack of sheets S is modeled as an ordered list of sheets.

In order to model more complex folds than a half fold, the second half fold function F may be extended with a position of the fold on the sheet(s). The more complex folding is orthogonal simple folding in 2D (two dimensions). The folds that are considered are in either X or Y direction and fold the whole sheet(s). Diagonal folds or folds that fold a part of the sheet, like from the edge to the center of the sheet, are not considered. The folds take into account all sheets in the stack, not a subset of them. Only flat folding will be considered, i.e. folds that produce a bunch of sheets lying on top of each other. Origami art and folds that produce three-dimensional structures are out of scope. These restrictions imply that every folding can be expressed as a series of successive folds.

Figure 7:
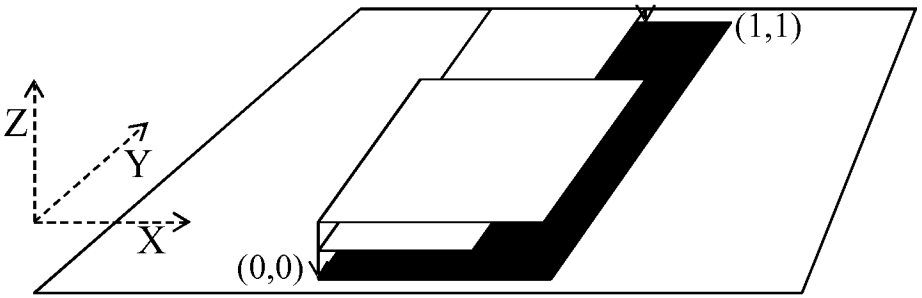
FIG. 7 shows an example of a bounding box according to the embodiment of the method of the present invention.

To define orthogonal simple folding in 2D a bounding box of a (stack of) sheet(s) is defined to be the smallest rectangle that contains the projection of the sheets onto the XY-plane as shown in FIG. 7. The grey rectangle in FIG. 7 is the bounding box. It is noted that the bounding box is normalized; the positions of the sheets is modeled in relation to the lower left corner of the bounding box. The definition of the bounding box will be used when describing a fold line.

A fold line has the following properties.

A fold line has an orientation: the fold line can be horizontal or vertical, in terms of the observer coordinate system.

A fold line has a direction: mountain or valley.

A fold line has a side: left or right. This is the side of the sheet at which the fold lies after folding.

A fold line has a distance relative to the lower left corner of the bounding box and expressed as the ratio of the position of the fold line and the bounding box Y size (for horizontal fold lines) or the bounding box X size (for vertical fold lines). The distance of a fold line f may be denoted with |f|, and the distance between two fold lines f1 and f2 as |f1−f2|. The distance between two fold lines is only defined if they have the same orientation (are both horizontal or both vertical).

Figure 8:
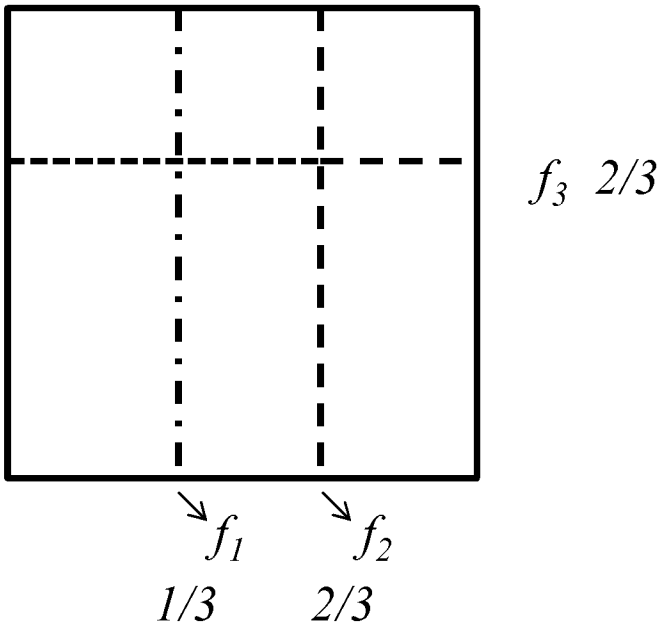
FIG. 8 shows a fold scheme according to the embodiment of the method of the present invention.

For example, in FIG. 8, f1 has a distance ⅓ and f3 has a distance ⅔. According to the standard origami convention, valley folds are drawn as dashed lines and mountain folds are drawn as dot-dashed lines. f1 is a mountain fold and f2 and f3 are valley folds. According to the JDF specification convention, the fold lines are drawn with a length according to a height or a width of the folded sheets as can be seen for f3. If such a fold line (the dotted line f3) was extended, a number of sheets that result from the successive folds becomes visible. After applying the folding actions according to fold lines f1, f2 and f3, the sheets which form the document have two different sizes.

For every fold line f both its fold type and its distance has to be taken into account. An identity fold line ϵ is introduced as a fold line which does not fold. The identity fold line (ϵ, d) has a distance d and an identity fold type ϵ. It is not needed to model the orientation (horizontal or vertical) for the identity fold line ϵ.

A fold scheme specifies in which order the sheet is folded. Hence the fold lines in a fold scheme are ordered. The fold lines are represented in an ordered list: One fold line comes before another fold line.

Figure 9:
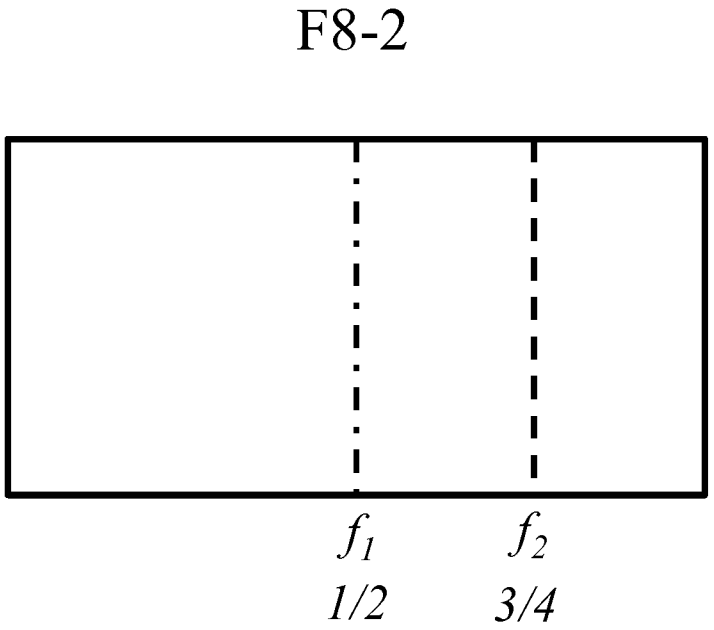
FIG. 9 shows a JDF fold scheme F8-2 according to the embodiment of the method of the present invention.

FIG. 9 shows a fold scheme F8-2 from the JDF specification. If a distance of the fold lines is discarded, this folding scheme F8-2 can be expressed in terms of the second half fold function and the fold type on the stack of sheets S. It can be expressed in several ways. After applying the folding actions according fold lines f1 and f2, the sheets which form the document have two different sizes.

For every sheet, the position of the sheet in the XY-plane is taken into account, relative to the lower-left corner of the bounding box of the stack of sheets. The same way as for the distance of a fold line is used to achieve this.

Figure 10:
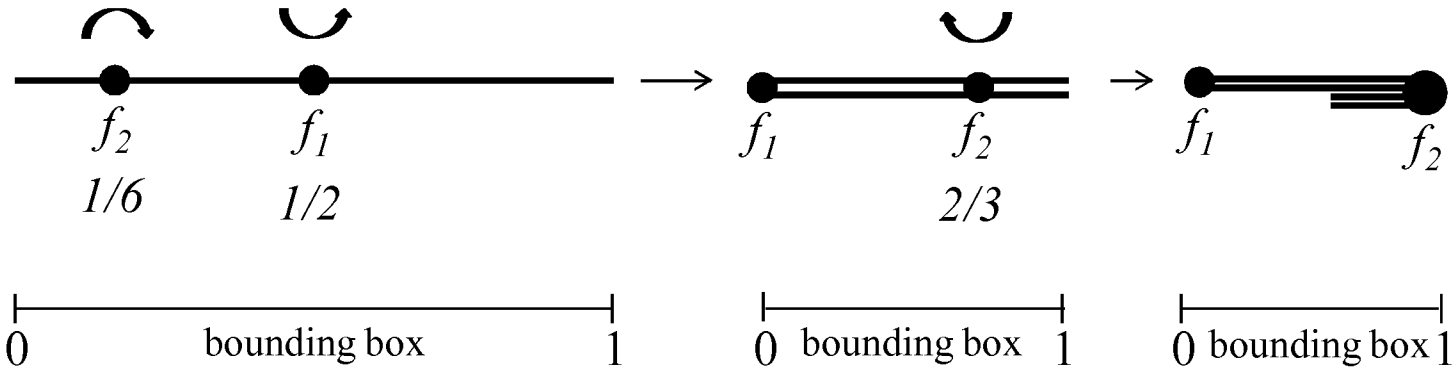
FIG. 10 shows another fold scheme according to the embodiment of the method of the present invention.

Another fold scheme is shown in FIG. 10. The following aspects are observed:

Every fold divides each sheet on the stack into two sub-sheets. Of these two sub-sheets, one is rotated in Z, the other sub-sheet stays stationary. In this example, the rotated sub-sheet is the sub-sheet at the left of f1 in the first fold step and the two sheets at the right of f2 in the second fold step. After applying the folding actions according fold lines f1 and f2, the sheets which form the document have two different sizes.

Every fold transforms the position of the sheets.

Every fold transforms the orientation of the rotated sheets.

Every fold transforms the position of the remaining fold lines.

Every fold transforms the type of the fold lines that are on the sub-sheet that is being rotated in Z direction (in this example f2).

Every fold reduces the X and Y size of the bounding box.

Figure 11:
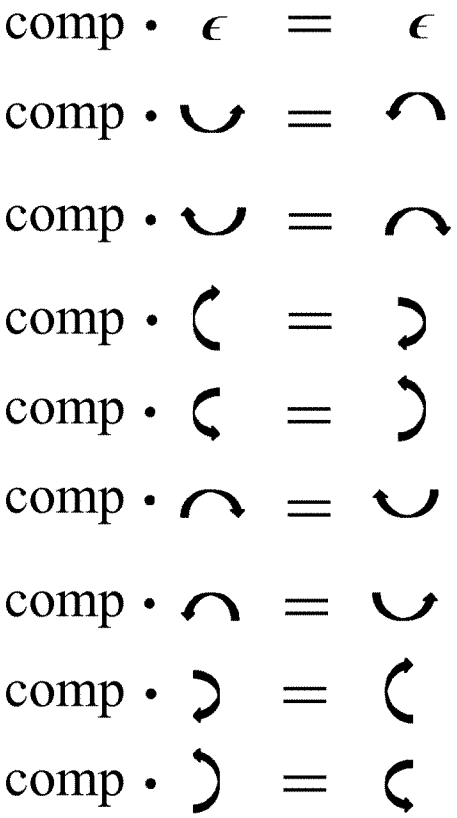
FIG. 11 shows a definition of a helper function comp according to the embodiment of the method of the present invention.

The transformation of the fold lines may be expressed by a function called trans. The function trans takes a fold line (over which the sheet is folded, the active fold line) and an ordered list of remaining fold lines and returns an ordered list of transformed fold lines. In FIG. 10, f2 is transformed into its complement after folding around f1: from a valley fold it becomes a mountain fold and its side changes from left to right. A function named comp as shown in FIG. 11 may be defined to express this phenomenon.

Figure 12:
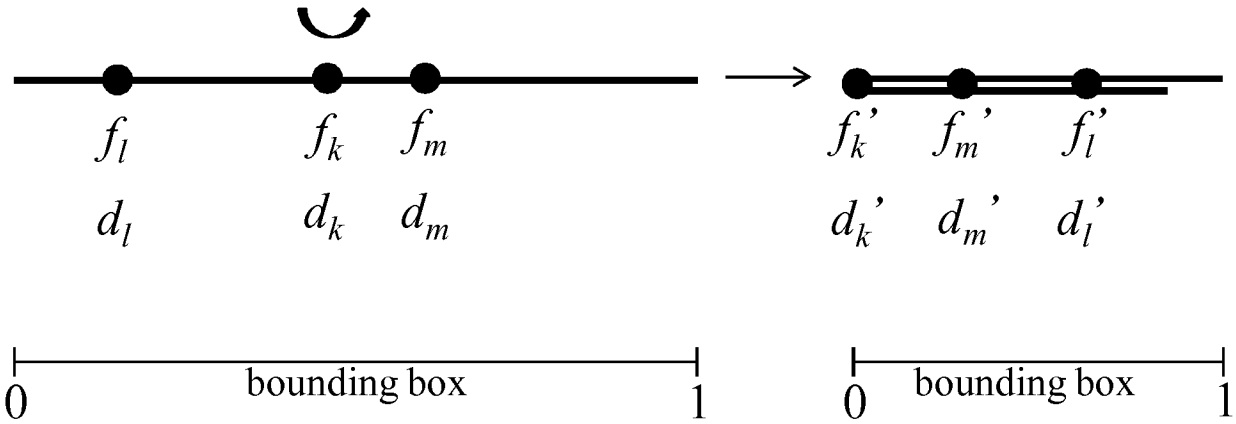
FIG. 12 shows a transformation of fold lines according to the embodiment of the method of the present invention.

FIG. 12 shows the transformation of the fold lines distances. The fold lines are shown as lines fi and their distances as di. It is noted that dl<dk<dm. FIG. 12 shows two kinds of transformations: for fold lines that are on the rotating sheet and for fold lines on the stationary sheet. In this case, the left sub-sheet is the rotating one, so fold lines on that sheet (f1 in this case) end up at the right of the active fold line. The distance of the fold lines on the stationary sheet also changes because the bounding box has changed after the fold. Equations in terms of the old distances may be derived for the new distances. For each fold type, analogous transformations may be constructed. In general, a transformation of some distance d for fold type φ over distance e may be expressed as a function on a fold line.

Fold lines that are orthogonal to the active fold line are not affected: when folding horizontally, the vertical fold lines stay the same and vice versa.

Before the function trans can be defined—the function that transforms a list of fold lines—one more helper function is defined by the inventor. A helper function map is a function on lists that maps a function onto each element of a list and returns a list of the results.

The function trans takes then a fold line and a list of fold lines, uses the helper function map and returns the list of fold lines after the fold is applied.

Figure 13:
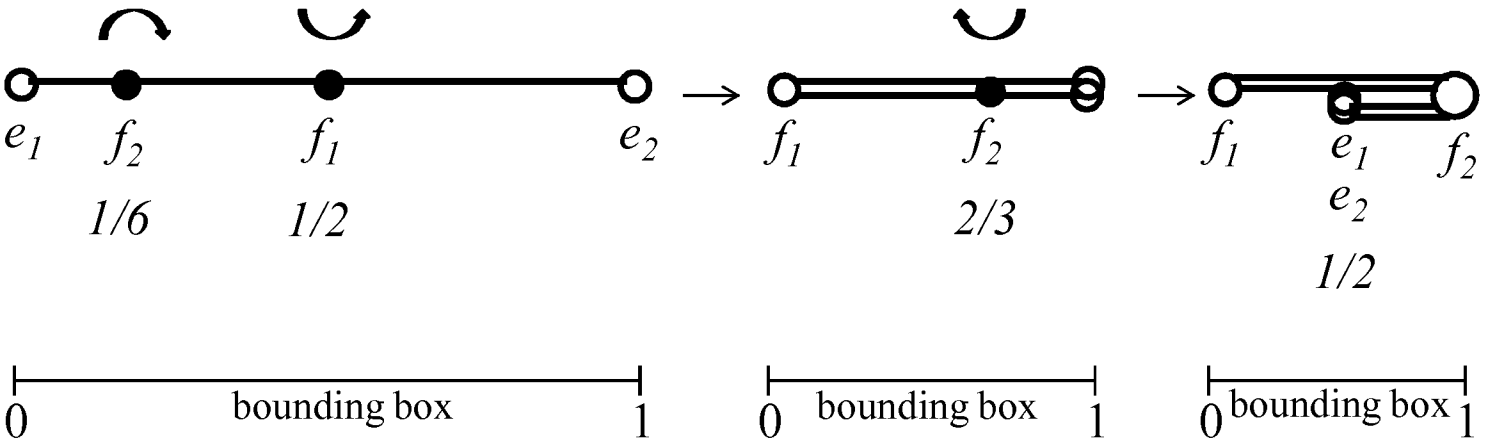
FIG. 13 shows sheet edges as fold lines according to the embodiment of the method of the present invention.

By means of FIG. 10, it is observed that a fold changes a sheet's XYZ orientation, a sheet's XY position and a sheet's order in the stack. The XY position is expressed relative to the lower left corner of the bounding box. Sheet edges e may be treated as a kind of special fold lines as shown in FIG. 13. If it is supposed that FIG. 13 shows the X dimension, the X position of the two lowest sheets after the second fold, is ½. As with fold lines, the positions of the sheet edges orthogonal to the active fold line are not affected. A fold line folds a sheet if and only if the fold line lies on the sheet. If a fold line does not lie on the sheet, it is said to not fold the sheet (Although it does transform the sheet).

Figure 14:
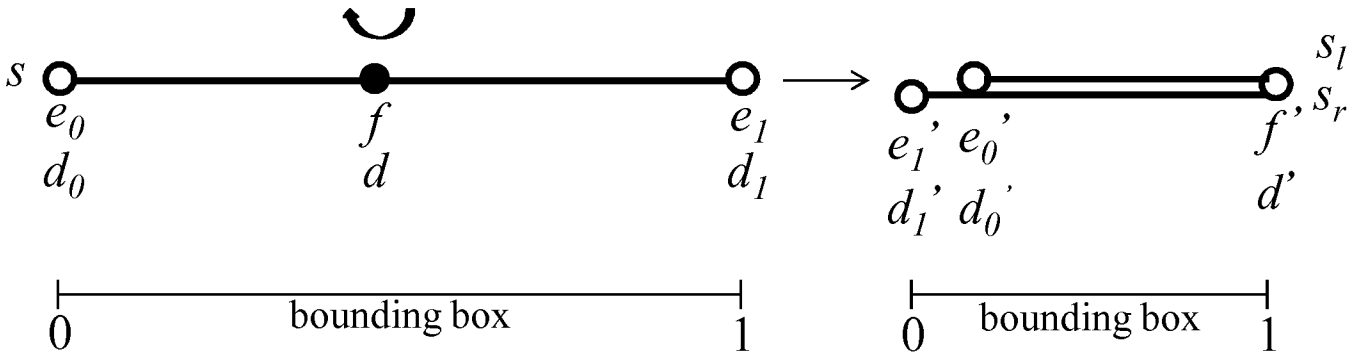
FIG. 14 shows a fold line lying on a sheet according to the embodiment of the method of the present invention.

FIG. 14 shows a fold line lying on the sheet s. After folding two sheets $s^l$ and $s^r$ are obtained. Fold line f becomes a sheet edge f'. Generally, with each fold, the active fold line becomes a sheet edge. Positions of the resulting sheets $s^l$ and $s^r$ may be expressed in the distances d0, d and d1 before folding. A sheet edge may be modeled as an identity fold line. The function trans may now also be used on a list of sheet edges.

A sheet has four edges, two horizontal edges and two vertical edges. Since the sheet edges are identity fold lines, the sheet edges have a distance with respect to the bounding box. A sheet's orientation can then be deduced from its edges. A sheet's position can also be deduced from its edges. Since all the things of interest in a sheet s can be deduced from its edges, the sheet s may be modeled as a list containing its four edges.

Figure 15:
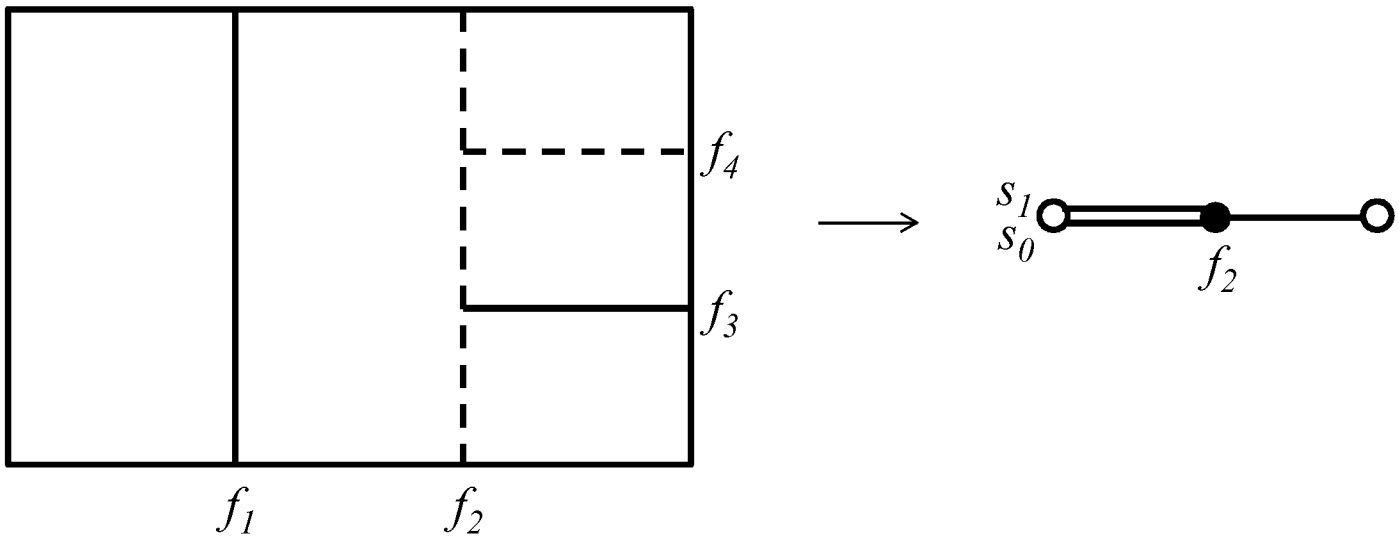
FIG. 15 shows a JDF fold scheme F18-5 according to the embodiment of the method of the present invention.

FIG. 15 shows JDF fold scheme F18-5. The distance |f1|=⅓ and the distance |f2|=⅔, so after folding over f1, the edge s0 lies at the same distance as f2. That means that folding over f2 does not have the same properties for s0 as for s1:s0 is not divided into two sub-sheets whereas s1 is. For reasons of symmetry, it is pretended that f2 does divide s0 in two: s0 itself and an empty sheet, denoted as sϵ. Since an empty sheet is a sort of virtual construct that has no counterpart in the "real" world it is not needed to keep track of its XY position or its XYZ orientation. The distance of the edges of an empty sheet may be defined as zero.

Figure 16:
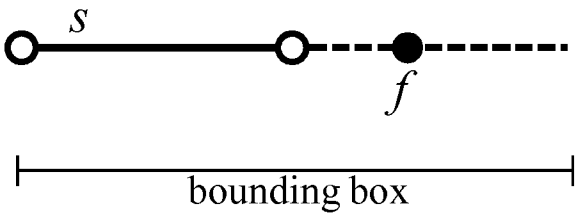
FIG. 16 shows a fold line lying outside a sheet according to the embodiment of the method of the present invention.

In this example, the fold line lies exactly at the edge of the sheet. This can be generalized to the case where the fold line lies at some distance from the sheet, so not even on the edge, but really outside the sheet as shown in FIG. 16. In other words, the sheet s is temporarily extended to the bounding box and subsequently folded.

Figure 17:
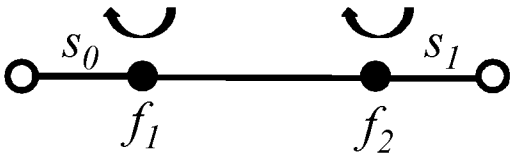
FIG. 17 shows a JDF fold scheme F6-3 according to the embodiment of the method of the present invention.
Figure 18:
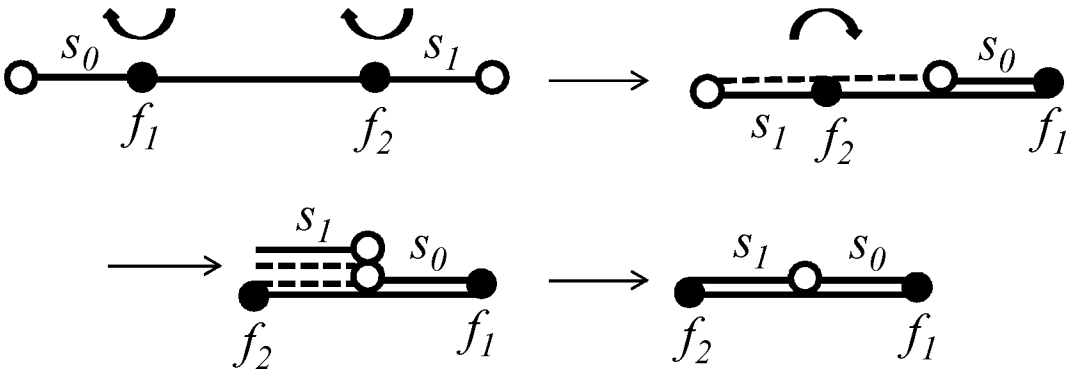
FIG. 18 shows empty sheets in combination with the JDF fold scheme F6-3 according to the embodiment of the method of the present invention.

So far, sheets are specified to lie on top of each other. An ordering has been introduced to specify this "on-top-of" order. However, not every fold scheme preserves this order, for example JDF fold scheme F6-3. FIG. 17 shows that sheets s0 and s1 do not lie on top of each other after folding over f1 and f2. So strictly speaking there is no ordering for s0 and s1. For reasons of simplicity, it is pretended that the sheets do lie on top of each other. This pretention does not invalidate the folding function developed so far. The ordering is introduced to model the order of the sheets in a stack of sheets. If a sheet is folded according to the F6-3 fold scheme, empty sheets could be taken into account. After folding is finished, the empty sheets may be removed from the stack as shown in FIG. 18. So taking into account the empty sheets preserves the ordering. After applying the folding actions according fold lines f1 and f2, in FIG. 18, the sheets which form the document have two different sizes.

Successive folding actions may be envisioned and contemplated in line with the previous examples by the skilled person, which result in a document having a plurality of sheets of more than two different sizes.

At this stage, a folding function G may be developed that performs successive folds on a list of sheets. For example, the F6-3 fold scheme can be expressed by means of the function G.

A function g can be derived for folding a single sheet s taking the fold line and the sheet s as input, using the trans function and delivering an ordered list of sheets.

The function g can be generalized to a function g for folding a stack of sheets S taking the fold line and the stack of sheets S as input and delivering an ordered list of sheets. The function g does one fold on a stack of sheets S. The function G is now defined that does several folds on a stack of sheets S. The function G has as input the set of fold lines, the stack of sheets S, uses the trans function and delivers an ordered list of sheets. The function G can be defined in such a way that it preserves the order on the list of sheets.

The function G expresses 2D orthogonal folds on a stack of sheets. Using this function G, arbitrary 2D orthogonal fold schemes can be described. This includes all fold schemes in the JDF specification. The function G can serve as the definition of fold operations in the function generator in a document processing system according to the present invention. A folding device according to the present invention has an interface to receive output from the function generator of the document processing system in order to fold a stack of sheets according to an arbitrary 2D orthogonal folding scheme.

In a further embodiment, the function g and the function G are extended to a function g+ and a function G+, respectively, by taking into account that when a sheet is folded, the resulting sheets are joined together at an edge where the fold line is. A sheet join may be modeled as a tuple of the two sheet edges that are joined. A function split may be introduced, which has as input a sheet and a fold line and as output the two sub-sheets created by the fold line and the corresponding join. The function g+ produces the ordered list of folded sheets, like the function g, and a list of corresponding sheet joins. The function G+ analogously produces the list of sheet joins for every fold. This extension G+ of the function G is advantageous when producing an imposition for the original stack of sheets in order to create the folded stack of sheets. By applying the function G+ and programming the unfolding of the folded stack of sheets by inverting the function G+a suitable imposition may be derived, delivered and/or displayed.

Figure 19:
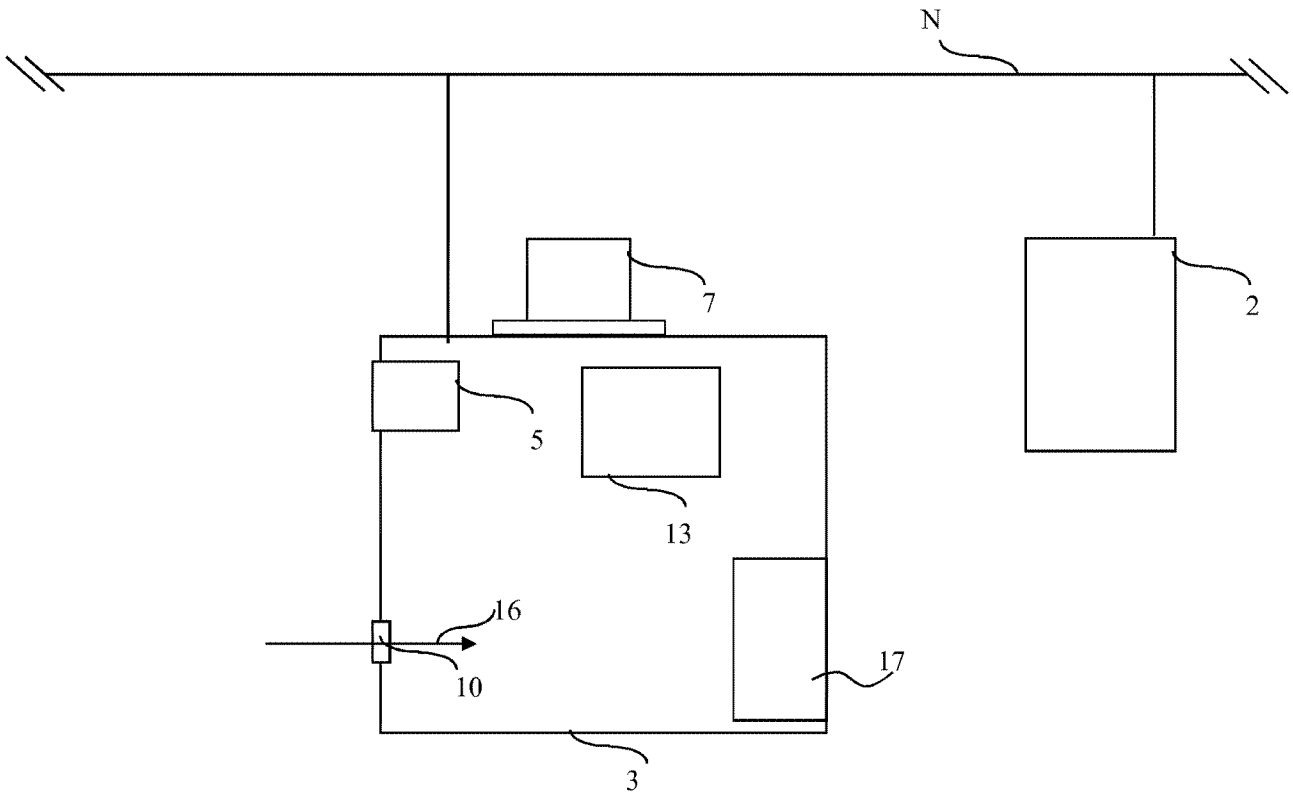
FIG. 19 shows a schematic view of a folding device according to the present invention.

FIG. 19 is a schematic view of a folding device 3 according to the present invention. The view is showing the folding device 3 connected to a network N and comprising a folding interface 5 in the folding device 3 for an optional data connection (not shown) to a printing device (not shown) for printing the stack of sheets before folding, a folding device console 7, a stack of sheets inlet 10, a folding control unit 13 in the folding device 3, and an output holder 17 on the folding device 3 for holding the folded stack of sheets. The folding interface 5 is configured to exchange digital information about folding instructions, which folding instructions are needed for processing the stack of sheets in order to lead to the desired end product. The folding interface 5 may exchange data via the network N. The stack of sheets may be laid into the inlet 10 in a single movement or may be transported one by one to the inlet 10 in order to enter the folding device 3, the sheet flow direction indicated by arrow 16.

Folding instructions may be part of the specifications of a folding job received via the network N from a document processing system 2. Folding instructions may also be entered via folding device console 7 and stored in memory of the folding control unit 13. The folding device 3 is configured to fold a stack of sheets, but may also be configured to trim or cut the folded stack of sheets by an internal trimmer or cutter respectively.

The document processing system 2 may be a computer or workstation having a user interface. The document processing system 2 is configured to receive a fold job for the stack of sheets. The document processing system 2 may also be configured to receive a submitted print job to be printed on a stack of sheets with a folding instruction for the printed stack of sheets. In the latter case, the document processing system 2 may comprise or may be connected to a printing device in order to print the print job on the stack of sheets. The printing device may be positioned near the inlet 10 of the folding device 3 for a flawless delivery of the printed stack of sheets to the folding device 3.

In the memory of the document processing system 2, a first software application resides that is capable of executing the steps of the method according to the present invention. The modeling steps explained in FIGS. 1-18 may be used to implement the first software application. The folding instruction generated according to the method by means of the first software application is sent to the folding device via the network N.

In the memory of the document processing system 2, a second software application may reside, which is derived from the first software application in order to generate a preview of the folded stack of sheets, for example a reader spread of the folded stack of sheets.

The reader spread is defined as a set of pairs of adjacent pages of sheets in a folded document or book. Since the ordering of the folded stack of sheets is known as well as the orientation of each sheet in the folded stack of sheets, the reader spread is derivable from the result of the first software application applied to the stack of sheets in a straightforward way. The generated preview may also be sent to the folding device 3 in order to display the generated preview on the folding device console 7.

In the memory of the document processing system 2, a third software application may reside, which is derived from the first software application in order to generate at least one imposition for the stack of sheets to be folded. The third software application may also be able to generate a preview of the at least one generated imposition. The generated preview of the at least one imposition may also be sent to the folding device 3 in order to be displayed on the folding device console 7 of the folding device 3.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for generating a folding instruction for orthogonal folding of a stack of sheets into a document, the method comprising steps of, for each sheet of the stack of sheets:

a) receiving an orthogonal folding action on the sheet defined as a fold type and an orientation relative to an observer, the fold type selected out of a mountain fold right, a mountain fold left, a mountain fold bottom, a mountain fold top, a valley fold right, a valley fold left, a valley fold bottom and a valley fold top;

b) generating at least one folding describing function having the orthogonal folding action and the sheet as input, and at least one ordered list of new sheets with an orientation relative to the observer of each new sheet of the at least one ordered list of new sheets as output, each new sheet of output comprising two sub-sheets created by each orthogonal folding action and a corresponding join;

c) repeatedly applying steps a) and b) to each new sheet of the at least one ordered list of new sheets until the sheets in last applied steps a) and b) form the document; and generating a folding instruction comprising a concatenation of the at least one generated folding describing function on the stack of sheets, the folding instruction intended to be transmitted to a folding device for orthogonal folding the stack of sheets into the document;

transmitting the folding instruction from a document processing system to the folding device;

receiving the folding instruction from the document processing system by the folding device; and folding the stack of sheets by the folding device into the document according to the folding instruction, wherein the orthogonal folding action on the sheet is also defined as a distance of an edge of the sheet to a fold line to be created by the orthogonal folding action, and wherein the sheets that result from the step of folding the stack of sheets and form the document have at least two different sizes, and wherein the method further comprises upon a missing order for two new sheets, introducing empty digital sheets to complete the ordering of the two new sheets in the stack and removing the empty digital sheets from the stack after folding is digitally finished.

2. The method according to claim 1, further comprising steps of:

generating a preview of the folded stack of sheets; and displaying the generated preview.

3. The method according to claim 1, wherein the step of generating at least one function comprises a step of generating as an output of the at least one function a sheet join for each pair of sheets in the at least one ordered list of new sheets, the pair of sheets being connected to each other by a fold line.

4. The method according to claim 3, wherein the step of generating as an output of the at least one the function further comprises a step of generating an imposition for the original stack of sheets in order to create the folded stack of sheets.

5. The method according to claim 4, further comprising steps of:

generating a preview of the imposition on the original stack of sheets; and displaying the generated preview.

6. A folding device for folding a stack of sheets, the folding device comprising:

a receiver configured to receive a folding instruction generated by the method according to claim 1, wherein the folding device is configured to fold the stack of sheets into the document according to the folding instruction.

* * * * *